US007051721B2

(12) United States Patent
Tomita et al.

(10) Patent No.: US 7,051,721 B2
(45) Date of Patent: May 30, 2006

(54) BLOWBY GAS CIRCULATION SYSTEM AND THE METHOD OF CIRCULATION

(75) Inventors: Kazushi Tomita, Tokyo (JP); Yasuhiro Kaneko, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/613,074

(22) Filed: Jul. 7, 2003

(65) Prior Publication Data

US 2004/0007204 A1 Jan. 15, 2004

(30) Foreign Application Priority Data

Jul. 8, 2002 (JP) ..... P. 2002-198354

(51) Int. Cl.
*F01M 13/00* (2006.01)

(52) U.S. Cl. ..... 123/572

(58) Field of Classification Search ..... 123/572–574, 123/41.86

See application file for complete search history.

(56) References Cited

U.S. PATENT DOCUMENTS 4,667,647 A * 5/1987 Ohtaka et al. ..... 123/573
6,029,638 A * 2/2000 Funai et al. ..... 123/572
6,148,807 A * 11/2000 Hazen ..... 123/572
6,405,721 B1 * 6/2002 Moren ..... 123/572
6,431,157 B1 * 8/2002 Marcil ..... 123/568.11
6,435,170 B1 * 8/2002 Hamelink et al. ..... 123/572
6,439,215 B1 * 8/2002 Sato et al. ..... 123/572
6,561,154 B1 * 5/2003 Ito et al. ..... 123/195 C
6,598,595 B1 * 7/2003 Yasui ..... 123/572
6,644,290 B1 * 11/2003 Yoneyama et al. ..... 123/572
6,695,658 B1 * 2/2004 Muramatsu ..... 440/88 L
6,763,814 B1 * 7/2004 Gokan ..... 123/572

FOREIGN PATENT DOCUMENTS

JP 11-148333 6/1999

* cited by examiner

*Primary Examiner*—Marguerite McMahon
(74) *Attorney, Agent, or Firm*—McGinn IP Law Group, PLLC

(57) ABSTRACT

A blowby gas circulation system for an engine having a crankcase and an intake system includes an oil tank which is independent of the crankcase, a first breather chamber and second breather chamber which are integrally provided with the crankcase. The oil tank supplies engine oil reserved therein to the crankcase and introduces a first gas-liquid mixture generated in the crankcase. The first gas-liquid mixture is separated into a second gas-liquid mixture and engine oil in the oil tank. Then, the second gas-liquid mixture is sent to a first breather chamber, being separated into a third gas-liquid mixture and engine oil. The third gas-liquid mixture is sent to a second breather chamber in which the third gas-liquid mixture is separated into blowby gas and engine oil. The blowby gas is sucked into the intake system and the engine oil is returned to the crankcase.

22 Claims, 8 Drawing Sheets

BLOWBY GAS CIRCULATION SYSTEM AND THE METHOD OF CIRCULATION

BACKGROUND OF THE INVENTION

1. Field of the Invention

The present invention relates to a blowby gas circulation system for a drysump lubrication type engine and a method of circulating blowby gas.

2. Discussion of Background Arts

Japanese Patent Application Laid-open No. Toku-Kai-Hei 11-148333 discloses a technology of a blowby gas circulation system for a drysump lubrication type engine. Specifically, in the blowby gas circulation system, a mixture of liquid (engine oil) and gas (blowby gas generated in a crankcase) is introduced to a breather chamber and the separation of gas from liquid is performed therein. The separated blowby gas is introduced to an intake system of the engine and the separated oil is returned to the crankcase. Further, the liquid and gas mixture in an oil tank is introduced to the breather chamber and the aforesaid separation of gas from liquid is performed.

However, according to the aforesaid prior art, since the greater part of the liquid and gas mixture in the crankcase is guided directly to the breather chamber, in case where the amount of the liquid and gas mixture exceeds a capacity of separating gas from liquid, the separation of gas from liquid can not be effectively performed. As a result, the liquid and gas mixture blows out from the breather chamber and engine oil flows out to the intake system and an adverse effect is brought to an air cleaner and the like.

SUMMARY OF THE INVENTION

It is an object of the present invention to provide an engine in which gas and liquid are effectively separated from a gas-liquid mixture generated in the crankcase and engine oil is prevented from flowing out to an intake system of the engine.

To attain the object, a blowby gas circulation system comprises an oil tank for supplying engine oil reserved therein to a crankcase and for introducing a gas-liquid mixture generated in the crankcase and for separating the gas-liquid mixture into gas-liquid mixture and engine oil, a first breather chamber for introducing the gas-liquid mixture and for separating the gas-liquid mixture into gas-liquid mixture and engine oil and for returning the engine oil to the crankcase and a second breather chamber for introducing the gas-liquid mixture and for separating the gas-liquid mixture into blowby gas and engine oil and for sending the blowby gas to an intake system and for returning the engine oil to the crankcase.

DETAILED DESCRIPTION OF THE PREFERRED EMBODIMENTS

Figure 1:
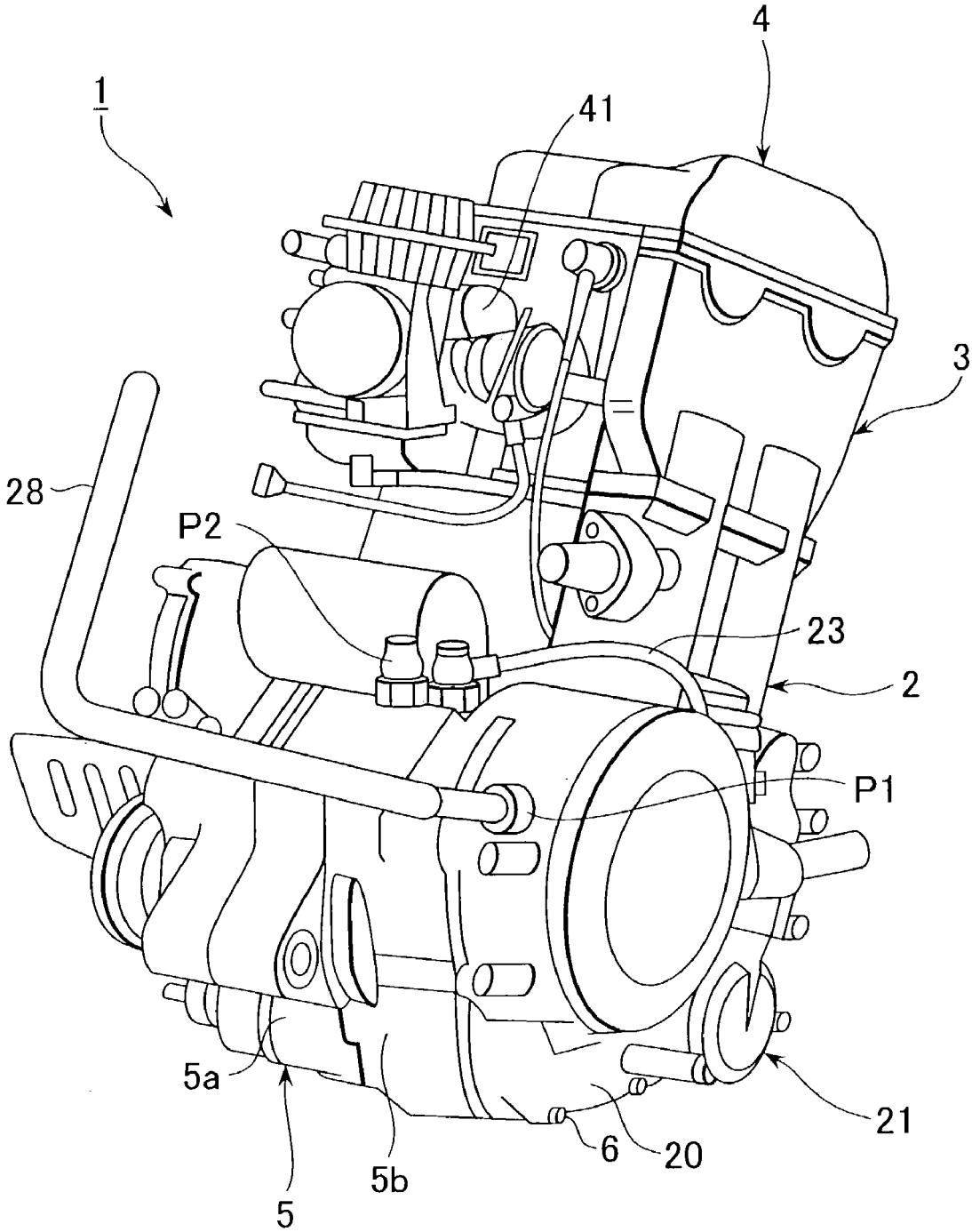
FIG. 1 is a perspective view showing a drysump lubrication type engine incorporating a blowby gas circulation system according to an embodiment of the present invention.
Figure 2:
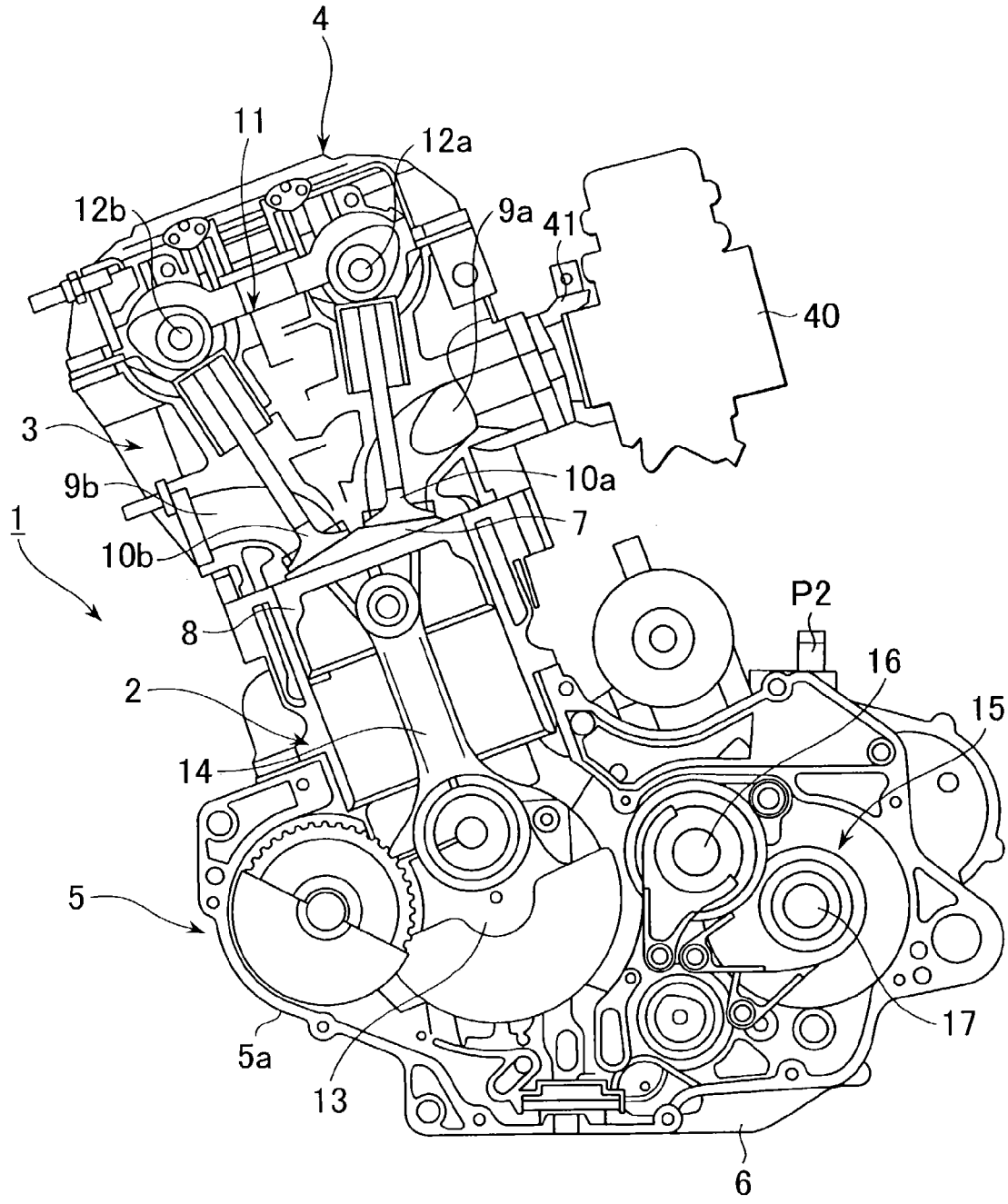
FIG. 2 is a sectional view showing an inside of the engine.
Figure 3:
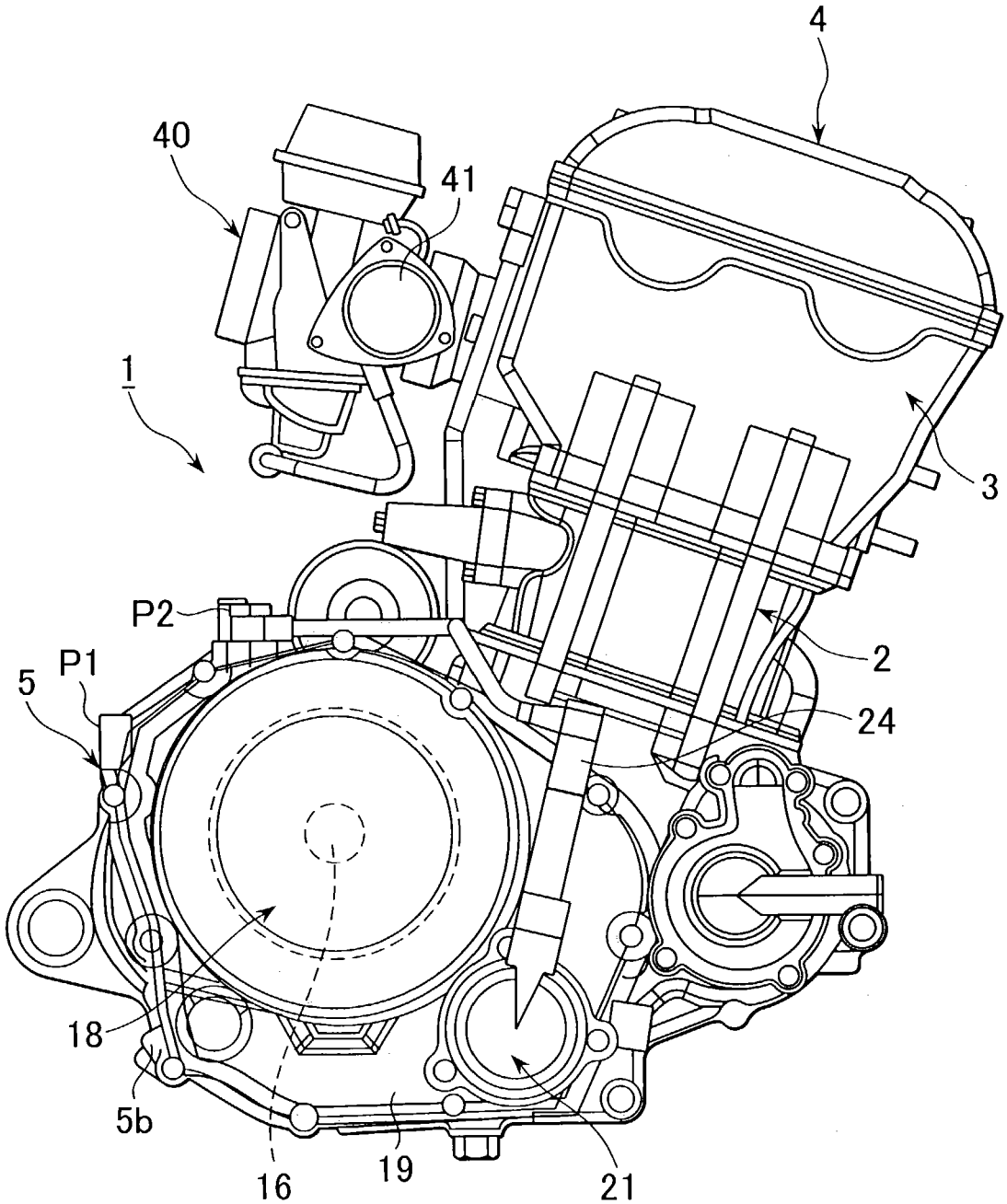
FIG. 3 is a side view of the engine.

Referring now to FIGS. 1, 2 and 3, an engine 1 is mainly constituted by a cylinder case 2, a cylinder head 3, a cylinder head cover 4, a crankcase 5 and an oil pan 6. The cylinder head 3 has a combustion chamber 7 and the cylinder case 2 has a cylinder in which a piston 8 is reciprocatably accommodated. The cylinder head 3 has an intake and exhaust ports 9*a*, 9*b* and an intake and exhaust valves 10*a*, 10*b* for opening and closing the intake and exhaust ports 9*a*, 9*b*, respectively. The intake and exhaust valves 10*a*, 10*b* are driven by two camshafts 12*a*, 12*b* constituting a part of a cam mechanism 11, respectively. The crankcase 5 is formed by integrally connecting a first crankcase 5*a* with a second crankcase 5*b*. A crankshaft 13 supported by the crankcase 5 is connected with a connecting rod 14 for transforming a reciprocating motion of the piston 8 into a rotational motion and transferring the rotational motion to the crankshaft 13.

The first crankcase 5*a* incorporates a transmission mechanism 15 having a main shaft 16 on which drive gears are mounted and a counter shaft 17 on which driven gears meshing with the drive gears are mounted. The crankshaft 13 transmits power to the main shaft 16 and the main shaft 16 transmits power to the counter shaft 17. A clutch unit 18 is mounted on the main shaft 16 and is covered by a clutch cover 20 attached to the second crankcase 5*b* through a gasket 19.

On the other hand, a first oil pump (feed pump) 21 is integrally incorporated in the crankcase 5. When the first oil pump 21 is operated, as shown in FIG. 4, an engine oil O in the oil tank 23 flows through a first oil passage 24 and is introduced to the inside of the cylinder case 2, the inside of the cylinder head 3 and the inside of the crankcase 5 to lubricate primary parts of the engine 1.

Figure 4:
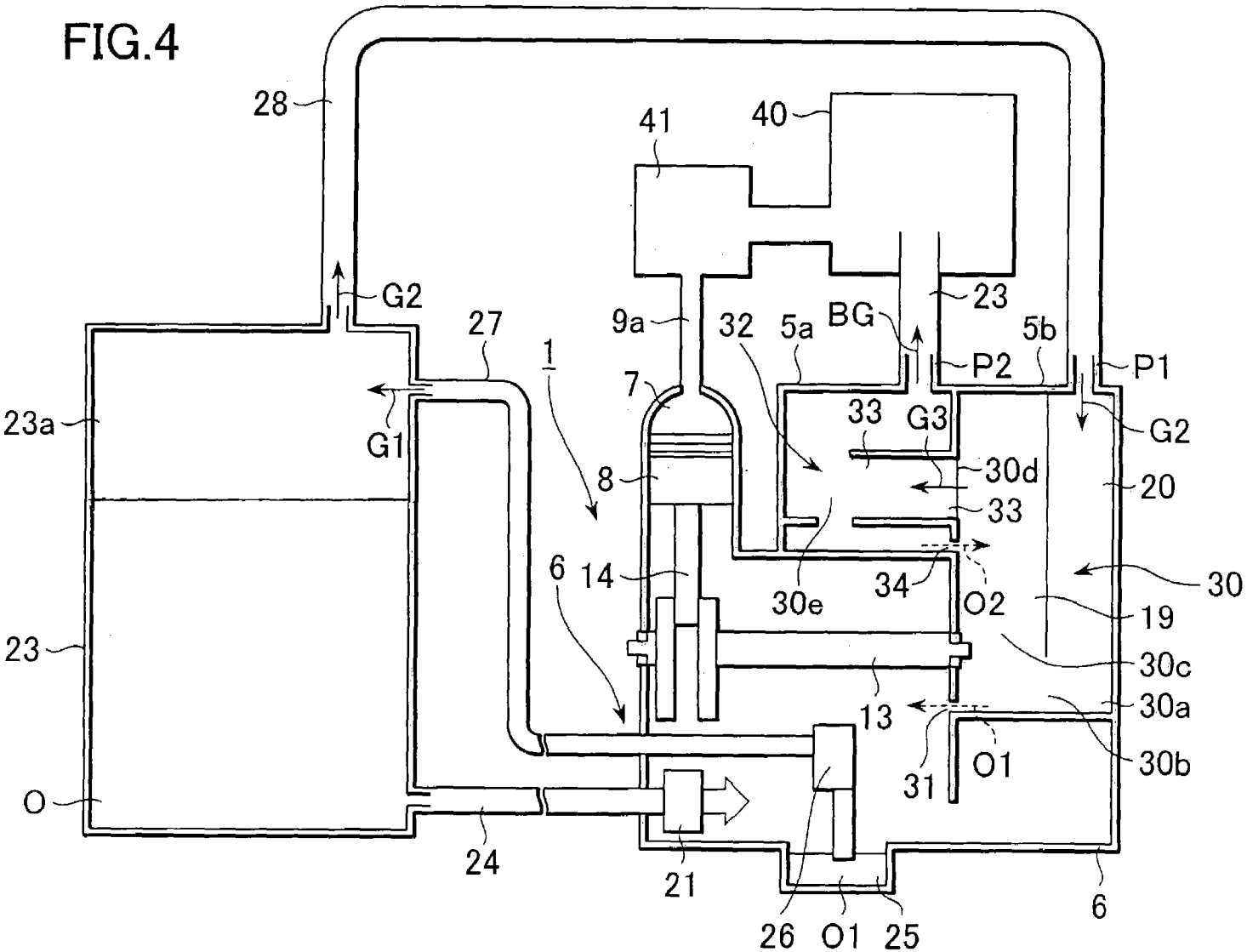
FIG. 4 is a schematic view showing a blowby gas circulation system according to the embodiment of the present invention.

According to an embodiment of the invention, as illustrated in FIG. 4, an engine oil O1 after lubrication returns to the inside of the crankcase 5 and is gathered to an oil basin 25 formed in the oil pan 6. The engine oil O1 gathered to the oil basin 25 is introduced through a second passage 27 to an upper space 23*a* in the oil tank 23 by a second oil pump (scavenging pump) 26. The engine oil O1 fed to the upper space 23*a* of the oil tank 23 contains blowby gas generated in the crankcase 5, forming a gas-liquid mixture G1. When the gas and liquid mixture G1 passes through the upper space 23*a* in the oil tank 23, a first gas-liquid separation is performed. The engine oil separated by this first gas-liquid separation flows downward in the oil tank 23 and is reserved there. The pumping power (oil feeding capacity) of the second oil pump 26 is established to a larger value than that of the first oil pump 21.

After the first gas-liquid separation is finished, a gas-liquid mixture G2 passes through a third passage 28 and is guided into a first breather chamber 30 through an input port P1. The gas-liquid mixture G2 passes through the first breather chamber 30, a second gas-liquid separation is performed. An engine oil O1 separated in the first breather chamber 30 is discharged from an oil return hole 31 provided at the bottom of the first breather chamber 30 and is gathered in the oil basin 25.

After the second gas-liquid separation is done in the first breather chamber 30, a gas-liquid mixture G3 is introduced through a communication port 33 to a second breather chamber 32 provided adjacent to and independently from the first breather chamber 30. When the gas-liquid mixture G3 passes through the second breather chamber 32, a third gas-liquid separation is performed. After the third gas-liquid separation is finished in the second breather chamber 32, an engine oil O2 is returned through a second oil return hole 34 and the first oil return hole 31 to the oil basin 25 and is reserved therein.

The gas-liquid mixture G3 after being subjected to the second gas-liquid separation in the first breather chamber 30 is separated into engine oil and a blowby gas BG containing little engine oil by a third gas-liquid separation in the second breather chamber 32. This blowby gas BG is discharged from the second breather chamber 32 to a fourth passage 23 through an output port P2 and is introduced to an air cleaner 40 of an intake system of the engine. Further, the blowby gas BG is introduced to a combustion chamber 7 of the engine 1 through the air cleaner 40, a carburetor 41 and an intake port 9*a*.

Figure 5:
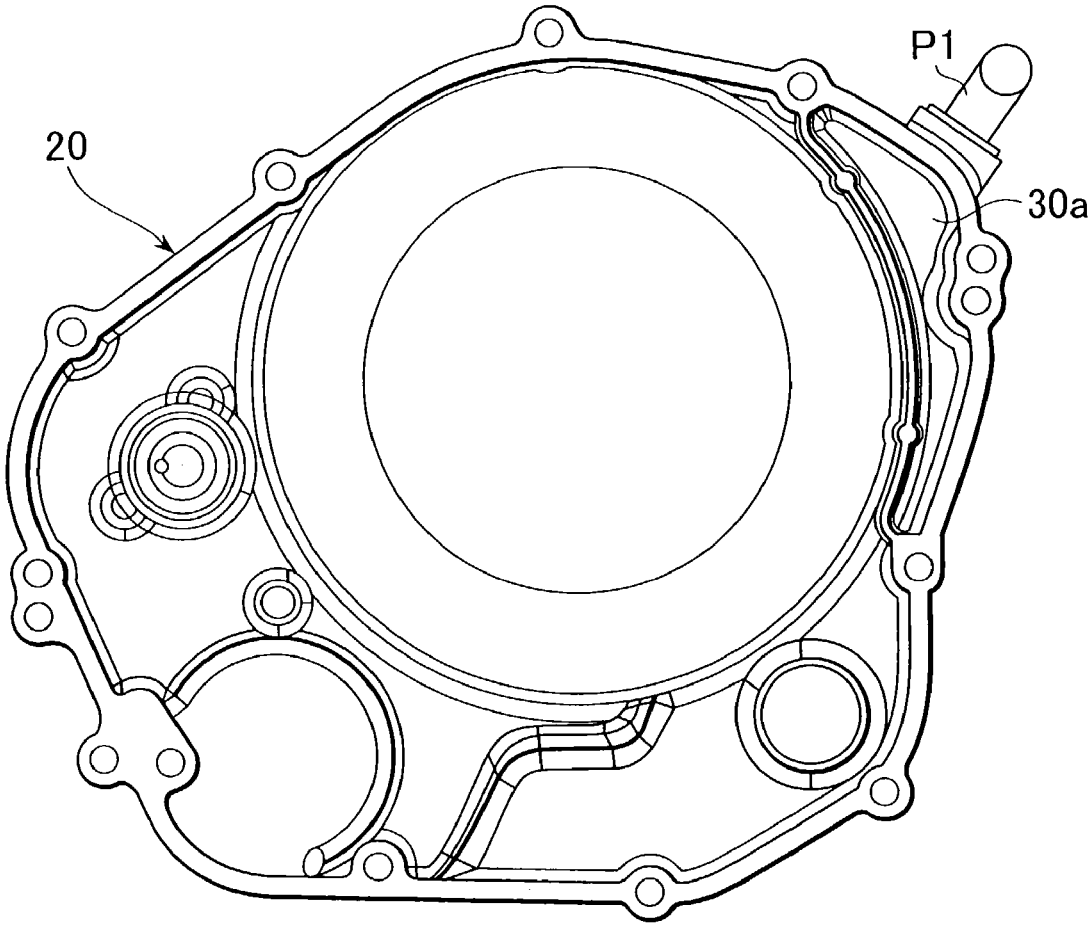
FIG. 5 is a rear view of a clutch cover of the engine.
Figure 6:
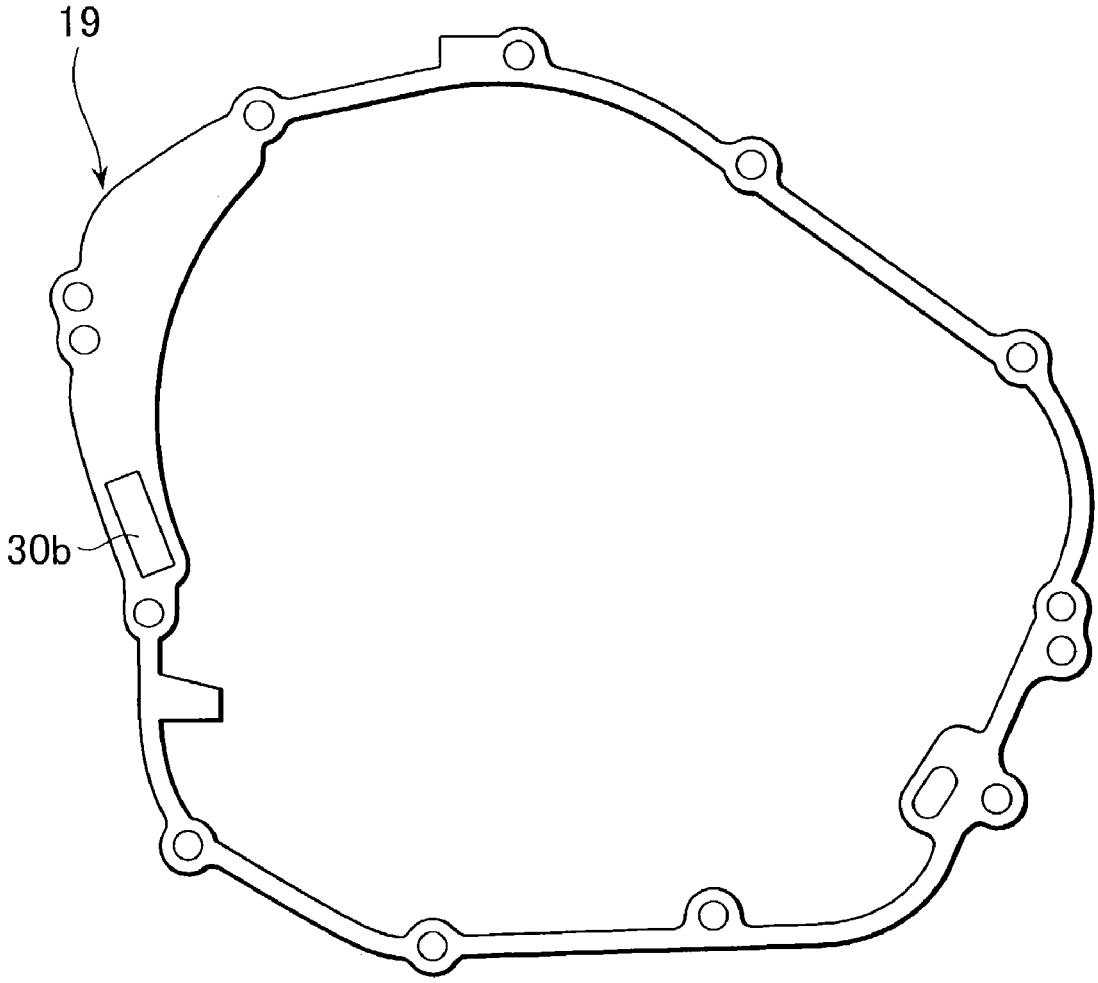
FIG. 6 is a front view showing a gasket of the engine.
Figure 7:
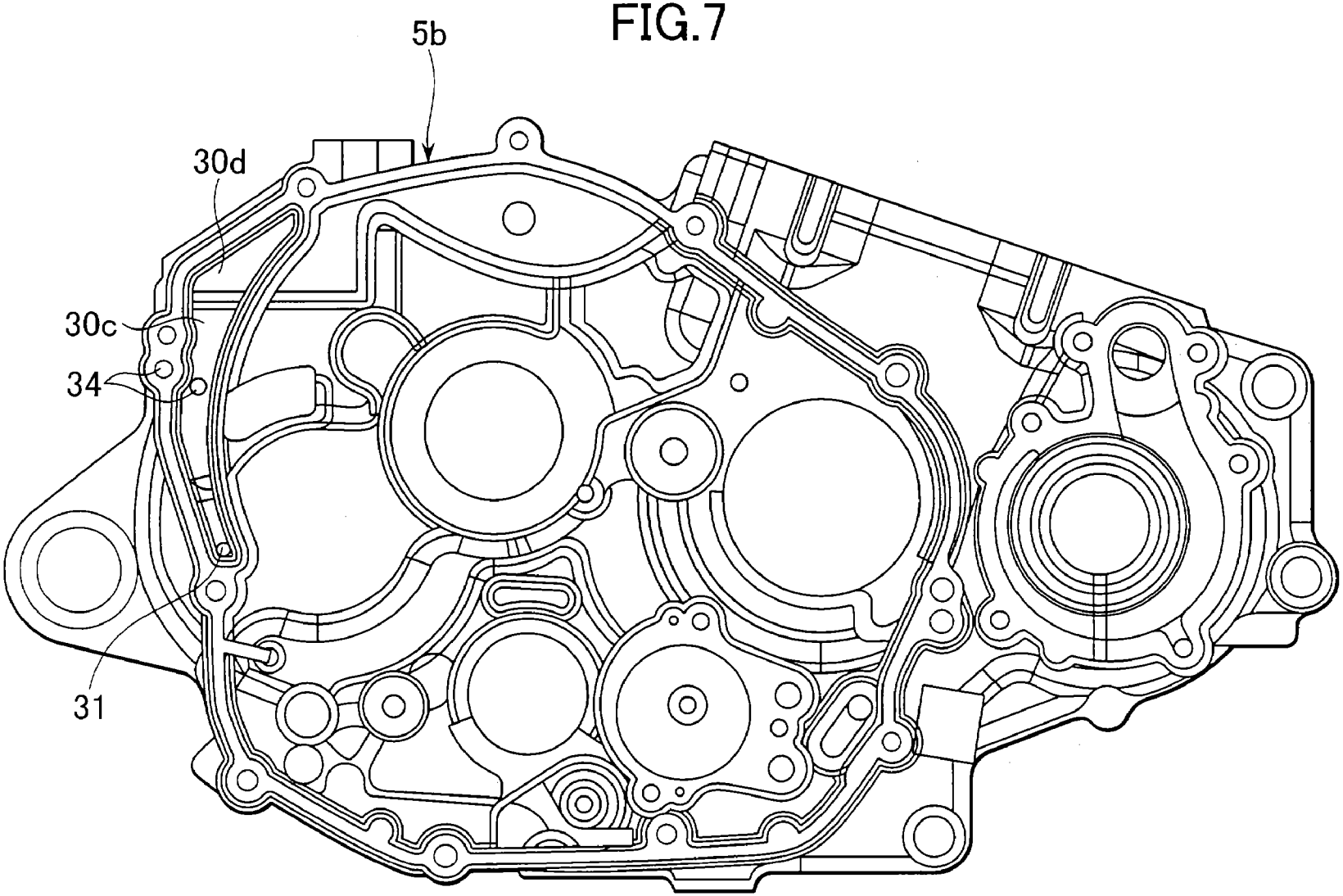
FIG. 7 is a front view showing a second crankcase of the engine.
Figure 8:
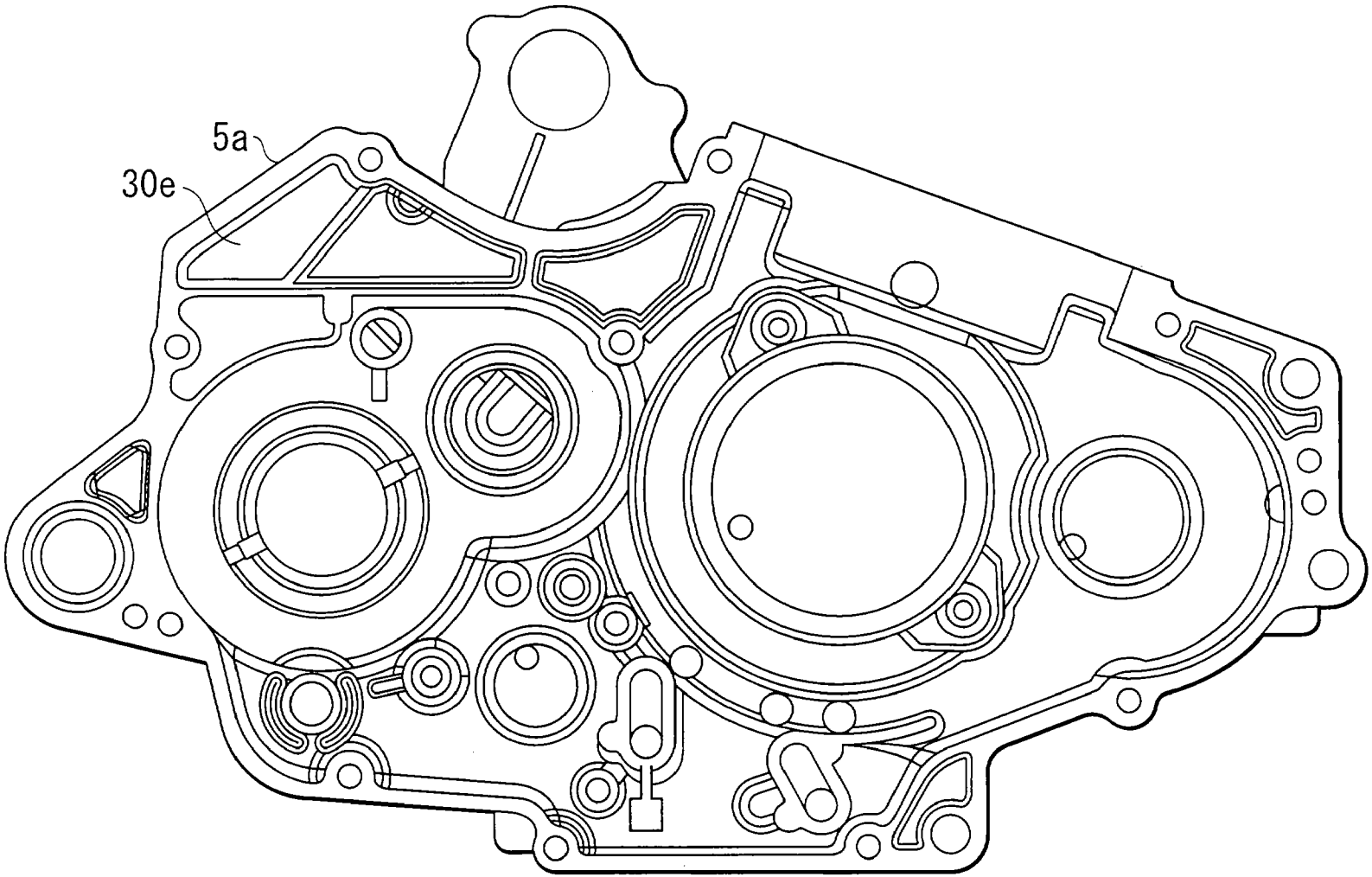
FIG. 8 is a front view showing a first crankcase of the engine.

The first breather chamber 30 and the second breather chamber 32 are integrally formed with the crankcase 5. As shown in FIG. 5, the clutch cover 20 has a first pocket 30*a* on the back side thereof to constitute a component of the first breather chamber 30. The clutch cover 20 is connected with the second crankcase 5*b* through the gasket 19. As shown in FIG. 6, the gasket 19 has a first communication passage 30*b* at a position corresponding to a lower part of the first pocket 30*a*. Further, as shown in FIG. 7, the second crankcase 5*b* has a second pocket 30*c* at a position corresponding to the first pocket 30*a* of the clutch cover 20. The second pocket 30*c* has the first oil return hole 31 for communicating between the second pocket 30*c* and the crankcase 5, the second oil return hole 34 for communicating between the first breather chamber 30 and the second breather chamber 32 and a second communication hole 30*d* for communicating to the communication port 33 of the second breather chamber 32. Further, as shown in FIG. 8, the first crankcase 5*a* has a third pocket 30*e* at a position corresponding to the second pocket 30*c* of the second crankcase 5*b*.

That is, when the clutch cover 20 is attached to the second crankcase 5*b* through the gasket 19, the first pocket 30*a* of the clutch cover 20 is superimposed on the second pocket 30*c* of the second crankcase 5*b*, thereby the first breather chamber 30 is formed. The first pocket 30*a* communicates with the second pocket 30*c* through the gasket 19. As a result, the gasket 19 serves as a labyrinth of the first breather chamber 30.

On the other hand, when the first crankcase 5*a* is connected with the second crankcase 5*b*, the second pocket 30*c* of the second crankcase 5*b* is superimposed on the third pocket 30*e* of the first crankcase 5*a*, thereby the second breather chamber 32 having a labyrinth is formed. The second pocket 30*c* communicates with the third pocket 30*e* through the second communication hole 30*d* and the communication port 33 and as a result the first breather chamber 30 communicates with the second breather chamber 32.

As described above, according to the embodiment, all of the gas-liquid mixture G1 generated in the crankcase 5 is gathered in the upper space 23*a* of the oil tank 23. After the gas-liquid mixture G1 is subjected to the first gas-liquid separation, the gas-liquid mixture G2 is introduced to the breather chambers 30 and 32. That is, since the gas-liquid mixture G2 which has experienced the gas-liquid separation to some extent is introduced to the breather chambers 30 and 32, there is a small possibility that the gas-liquid mixture G2 as much as exceeding a capacity of gas-liquid separation is introduced. As a result, since the gas-liquid separation is effectively performed in the breather chambers 30 and 32, engine oil can be prevented from running out to the intake system.

Further, since the pumping power of the second oil pump 26 is established to a larger value than that of the first oil pump 21, the inside of the crankcase 5 is kept in a vacuum condition with respect to the first breather chamber 30, thereby the engine oil O1 and O2 separated in the breather chambers 30, 32 are smoothly sucked into the crankcase 5.

Further, according to the embodiment, since the first and second breather chambers 30, 32 are integrally with the crankcase 5, the number of components of the blowby gas circulation system can be reduced.

The entire contents of Japanese Patent Application No. Tokugan 2002-198354 filed Jul. 8, 2002, is incorporated herein by reference.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments which can be embodied without departing from the principle of the invention set out in the appended claims.

What is claimed is:

1. A blowby gas circulation system for an engine including a crankcase and an intake system, comprising:

an oil tank provided independently from said engine, for supplying engine oil reserved therein to said crankcase, said oil tank receiving a gas-liquid mixture generated in said crankcase, and said oil tank separating said gas-liquid mixture into a processed gas-liquid mixture and engine oil; and a breather chamber integrally formed with said crankcase and including an input port connected to said oil tank through an outside passage, for receiving said processed gas-liquid mixture, said breather chamber separating said processed gas-liquid mixture into blowby gas and engine oil, said breather chamber sending said blowby gas to said intake system, and said breather chamber returning said engine oil to said crankcase.

2. The blowby gas circulation system according to claim 1, wherein said gas-liquid mixture generated in said crankcase is guided directly from said crankcase to said oil tank.

3. The blowby gas circulation system according to claim 1, wherein said gas-liquid mixture is introduced to said oil tank directly from said crankcase.

4. The blowby gas circulation system according to claim 1, wherein said gas-liquid mixture from said crankcase is guided to said oil tank without passing through said breather chamber.

5. The blowby gas circulation system according to claim 1, wherein said breather chamber receives said processed gas-liquid mixture other than directly from said crankcase.

6. The blowby gas circulation system according to claim 1, wherein said breather chamber receives said processed gas-liquid mixture from said crankcase via said oil tank.

7. The blowby gas circulation system according to claim 1, wherein an inside of the crankcase is kept in a vacuum condition with respect to the breather chamber.

8. A blowby gas circulation system for an engine including a crankcase and an intake system, comprising:

an oil tank provided independently from said engine, for supplying engine oil reserved therein to said crankcase, said oil tank receiving a first gas-liquid mixture generated in said crankcase, and said oil tank separating said first gas-liquid mixture into a second gas-liquid mixture and engine oil;

a first breather chamber including an input port connected to said oil tank through an outside passage, for receiving said second gas-liquid mixture, said first breather chamber separating said second gas-liquid mixture into a third gas-liquid mixture and engine oil, said first breather chamber returning said engine oil directly to said crankcase; and a second breather chamber for receiving said third gas-liquid mixture, said second breather chamber separating said third gas-liquid mixture into blowby gas and engine oil, said second breather chamber sending said blowby gas to said intake system, and said second breather chamber returning said engine oil to said crankcase.

9. The blowby gas circulation system according to claim 8, further comprising:

a first oil pump for feeding engine oil reserved in said oil tank to said crankcase; and a second oil pump for feeding said first gas-liquid mixture from said crankcase to said oil tank.

10. The blowby gas circulation system according to claim 9, wherein a pumping power of said second oil pump is larger than a pumping power of said first oil pump so as to produce a vacuum pressure in said crankcase.

11. The blowby gas circulation system according to claim 8, wherein said crankcase is formed by integrally connecting a first crankcase with a second crankcase.

12. The blowby gas circulation system according to claim 8, wherein said oil tank receives said first gas-liquid mixture generated in said crankcase directly from said crankcase.

13. The blowby gas circulation system according to claim 8, wherein said first gas-liquid mixture is introduced to said oil tank directly from said crankcase.

14. The blowby gas circulation system according to claim 8, wherein said first gas-liquid mixture from said crankcase is introduced to said oil tank without passing through at least one of said first breather chamber and said second breather chamber.

15. The blowby gas circulation system according to claim 8, wherein said first breather chamber receives said second gas-liquid mixture other than directly from said crankcase.

16. The blowby gas circulation system according to claim 8, wherein said first breather chamber receives said second gas-liquid mixture from said crankcase via said oil tank.

17. The blowby gas circulation system according to claim 8, wherein an inside of the crankcase is kept in a vacuum condition with respect to the breather chamber.

18. The blowby gas circulation system according to claim 8, wherein said first breather chamber is integrally formed with said crankcase.

19. The blowby gas circulation system according to claim 8, wherein said second breather chamber is integrally formed with said crankcase.

20. A blowby gas circulation system for an engine including a crankcase and an intake system, comprising:

an oil tank for supplying engine oil reserved therein to said crankcase, said oil tank receiving a first gas-liquid mixture generated in said crankcase, and said oil tank separating said first gas-liquid mixture into a second gas-liquid mixture and engine oil;

a first breather chamber for receiving said second gas-liquid mixture, said first breather chamber separating said second gas-liquid mixture into a third gas-liquid mixture and engine oil, said first breather chamber returning said engine oil to said crankcase; and a second breather chamber for receiving said third gas-liquid mixture, said second breather chamber separating said third gas-liquid mixture into blowby gas and engine oil, said second breather chamber sending said blowby gas to said intake system, and said second breather chamber returning said engine oil to said crankcase, wherein said crankcase is formed by integrally connecting a first crankcase with a second crankcase, wherein said first breather chamber is formed by superimposing a first pocket integrally provided with a clutch cover on a second pocket integrally provided with said second crankcase when said clutch cover is connected with said second crankcase, and wherein said second breather chamber is formed by superimposing said second pocket on a third pocket integrally provided with said first crankcase when said second crankcase is connected with said first crankcase.

21. A blowby gas circulation system for an engine including a crankcase and an intake system, comprising:

an oil tank provided independently from said engine, for supplying engine oil reserved therein to said crankcase, said oil tank receiving a first gas-liquid mixture generated in said crankcase, and said oil tank separating said first gas-liquid mixture into a second gas-liquid mixture and engine oil;

a first breather chamber including an input port connected to said oil tank through an outside passage, for receiving said second gas-liquid mixture, said first breather chamber separating said second gas-liquid mixture into a third gas-liquid mixture and engine oil, said first breather chamber returning said engine oil to said crankcase; and a second breather chamber for receiving said third gas-liquid mixture, said second breather chamber separating said third gas-liquid mixture into blowby gas and engine oil, said second breather chamber sending said blowby gas to said intake system, and said second breather chamber returning said engine oil to said crankcase, wherein said crankcase is formed by integrally connecting a first crankcase with a second crankcase, wherein said first breather chamber is formed by superimposing a first pocket integrally provided with a clutch cover on a second pocket integrally provided with said second crankcase when said clutch cover is connected with said second crankcase.

22. The blowby gas circulation system according to claim 21, wherein said second breather chamber is formed by superimposing said second pocket on a third pocket integrally provided with said first crankcase when said second crankcase is connected with said first crankcase.

* * * * *